US006155144A

United States Patent [19]

Lin

[11] Patent Number: 6,155,144

[45] Date of Patent: Dec. 5, 2000

[54] RETRACTABLE DRIVING TOOL

[76] Inventor: Hsing Tai Lin, P.O. Box 63-99, Taichung, Taiwan, 406

[21] Appl. No.: 09/366,266

[22] Filed: Aug. 2, 1999

[51] Int. Cl.[7] ..... B25B 23/00

[52] U.S. Cl. ..... 81/438; 81/177.2; 81/439

[58] Field of Search ..... 81/438, 439, 177.2, 81/177.6, 52, 57.42

[56] References Cited

U.S. PATENT DOCUMENTS

| | | | |
|---|---|---|---|
| 2,682,414 | 6/1954 | Richardson | 81/438 |
| 2,822,714 | 2/1958 | Paparelli | 81/439 |
| 4,328,721 | 5/1982 | Massari | 81/439 |
| 4,581,961 | 4/1986 | Lai | 81/439 |
| 5,024,565 | 6/1991 | Pinand | 408/121 |
| 5,136,900 | 8/1992 | Chapin | 81/52 |
| 5,878,637 | 3/1999 | Liu | 81/451 |
| 5,931,065 | 8/1999 | Jackson et al. | 81/177.2 |
| 6,029,549 | 2/2000 | Baker | 81/439 |
| 6,032,332 | 3/2000 | Lin | 16/111.1 |
| 6,044,733 | 4/2000 | Liu | 81/177.6 |

*Primary Examiner*—James G. Smith
*Assistant Examiner*—Hadi Shakeri

[57] ABSTRACT

A retractable driving tool includes a driving stem slidably received in a handle and includes a number of teeth. A pawl is slidably engaged in the handle and is biased to engage with the teeth of the driving stem and for securing the driving stem to the handle and for allowing the driving stem to be moved relative to the handle when the pawl is moved against a spring. A spring is disposed between the rear end of the handle and the driving stem for moving the driving stem forward and outward of the handle. A slide is engaged between the spring and the driving stem.

5 Claims, 6 Drawing Sheets

RETRACTABLE DRIVING TOOL

BACKGROUND OF THE INVENTION

1. Field of the Invention

The present invention relates to a tool, and more particularly to a retractable driving tool.

2. Description of the Prior Art

A typical retractable driving tool is disclosed in U.S. Pat. No. 5,878,637 to Liu and comprise a retractable telescopic pipe including a number of tubular members of different sizes slidably engaged with each other. However, the driving strengths of the tubular members of smaller sizes may be greatly decreased such that the driving tool may not be used to forcefully drive the fasteners or the like.

The present invention has arisen to mitigate and/or obviate the afore-described disadvantages of the conventional retractable driving tools.

SUMMARY OF THE INVENTION

The primary objective of the present invention is to provide a retractable driving tool having no telescopic structure and having a strength that will not be decreased.

In accordance with one aspect of the invention, there is provided a retractable driving tool comprising a handle including a bore formed therein, a driving stem slidably received in the bore of the handle and including a plurality of teeth formed thereon, a pawl slidably engaged in the handle for engaging with the teeth of the driving stem and for securing the driving stem to the handle, and means for biasing the pawl to engage with the teeth of the driving stem and to secure the driving stem to the handle. The driving stem is allowed to be moved relative to the handle when the pawl is moved against the biasing means and disengaged from the teeth of the driving stem.

The teeth of the driving stem are ratchet teeth, the driving stem includes a plurality of grooves formed between the teeth of the driving stem.

The handle includes a cavity and a channel formed therein, the channel is communicating with the bore of the handle, the pawl includes a knob and a panel slidably received in the cavity and the channel of the handle respectively, the biasing means is engaged between the handle and the pawl for biasing the panel of the pawl to engage with the teeth of the driving stem. The panel of the pawl includes a hole formed therein for receiving the teeth of the driving stem. The driving stem includes a rod extended therefrom and having the teeth extended from the rod, the panel of the pawl includes a notch formed therein and communicating with the hole of the pawl for receiving the rod of the driving stem when the panel is biased to engage with the teeth of the driving stem.

The handle includes a rear portion having a cap secured thereto, the driving stem includes a rear end located close to the cap, and the driving tool further includes a spring engaged between the cap and the rear end of the driving stem to bias the driving stem outward of the handle. A slide is slidably received in the bore of the handle and engaged between the spring and the rear end of the driving stem.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
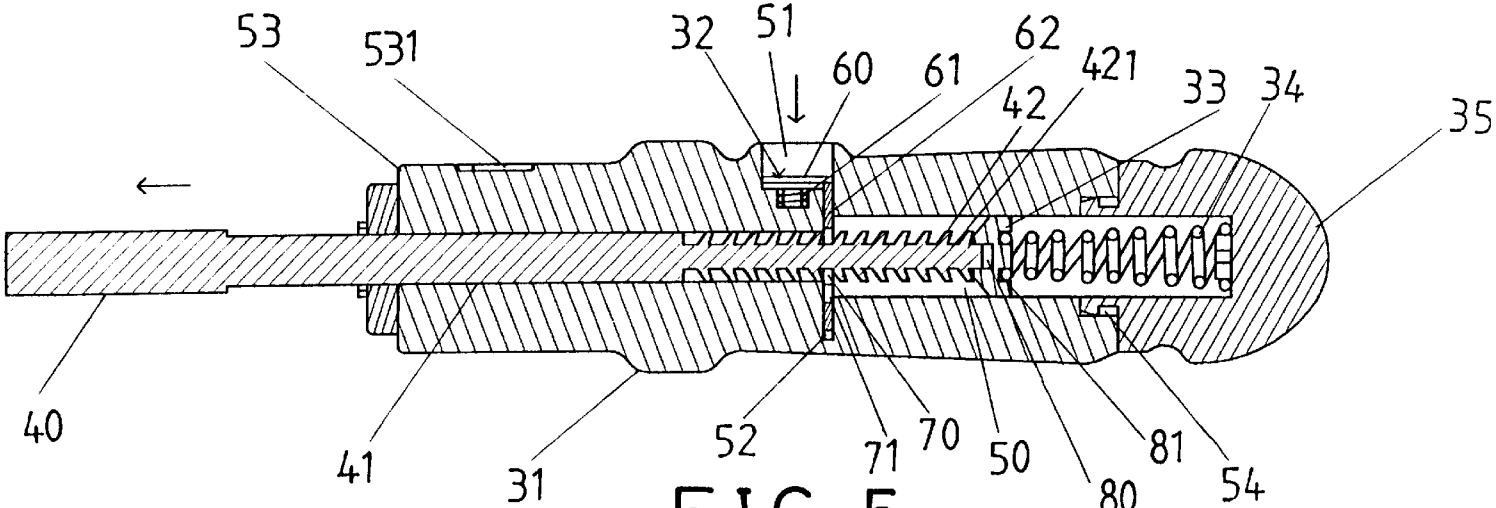
Figure 6:
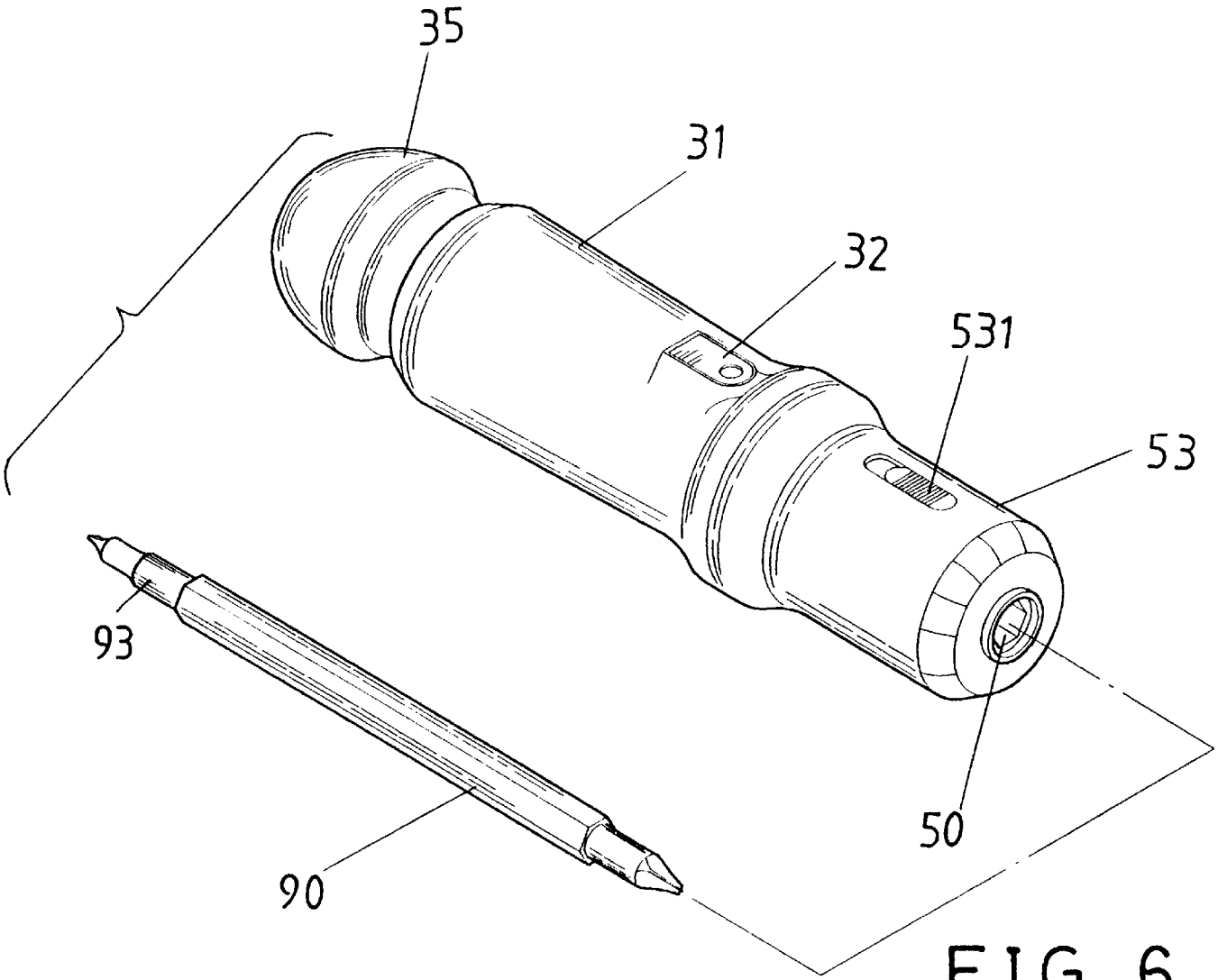
FIG. 6 an exploded view illustrating the other application of the retractable driving tool.
Figure 7:
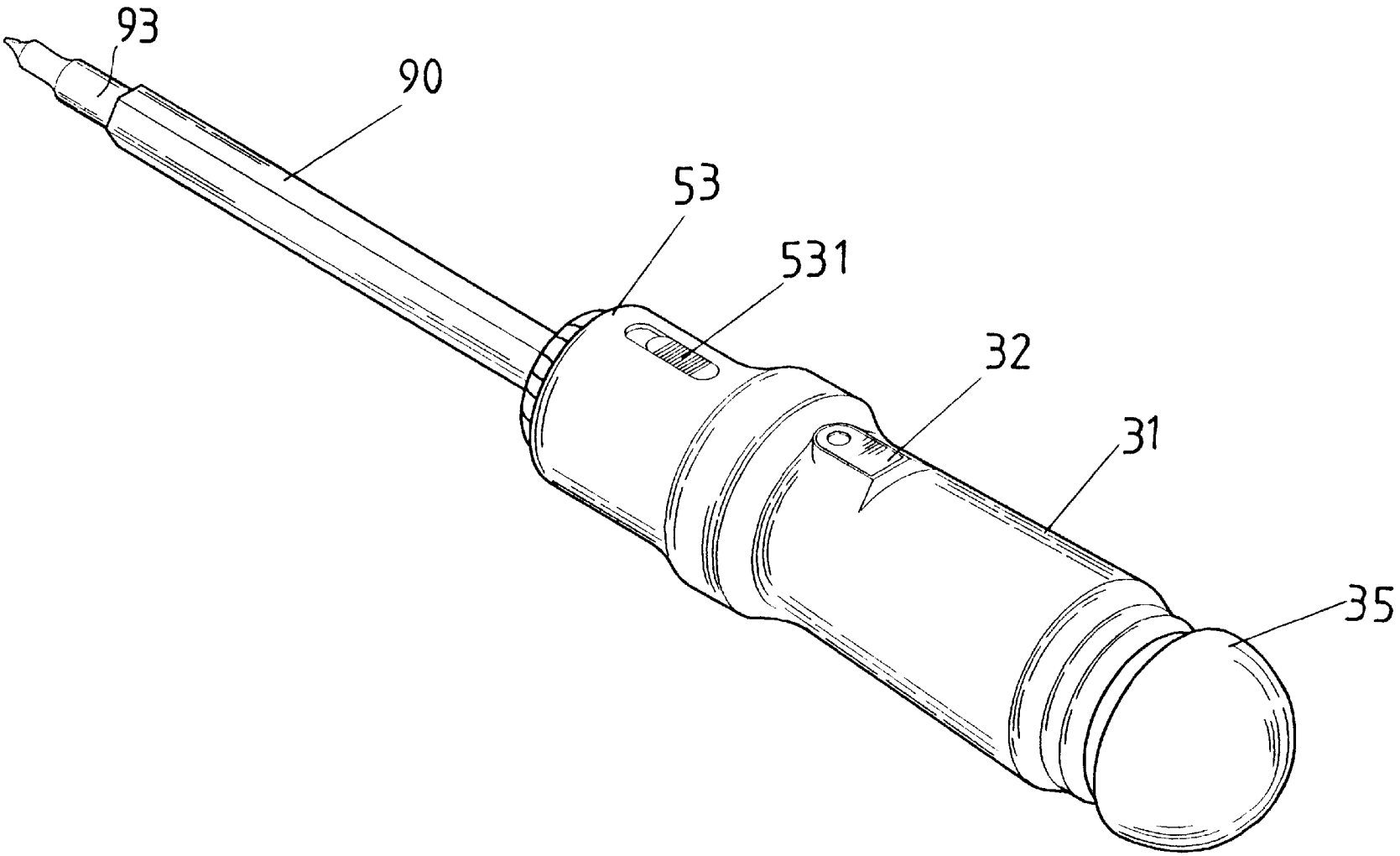
FIG. 7 is a perspective view of the driving tool as shown in FIG. 6.

Referring to the drawings, and initially to FIGS. 1–4, a retractable driving tool in accordance with the present invention comprises a handle 31 including a bore 50 (FIGS. 4–6) formed therein for slidably receiving a driving stem 41 or 90 (FIGS. 6, 7). The driving stems 41, 90 may include a hexagonal or a non-circular cross section, and the bore 50 of the handle 31 may also include a corresponding hexagonal or non-circular cross section for receiving the driving stems 41, 90 and for allowing the driving stems 41, 90 to be slidable in the handle 31 and to be rotated in concert with the handle 31. Alternatively, the driving stems 41, 90 and the bore 50 of the handle 31 may include a circular cross section. An additional ratchet control mechanism may be provided and disposed in one portion, particularly the front portion 53 of the handle 31, and may include a control knob 531 for actuating the ratchet control mechanism to control the driving directions of the driving stems 41, 90 by the handle 31. The driving stems 41, 90 may include a socket 40 or a driving tool bit 93 secured thereto for engaging with and for driving the fasteners.

Figure 1:
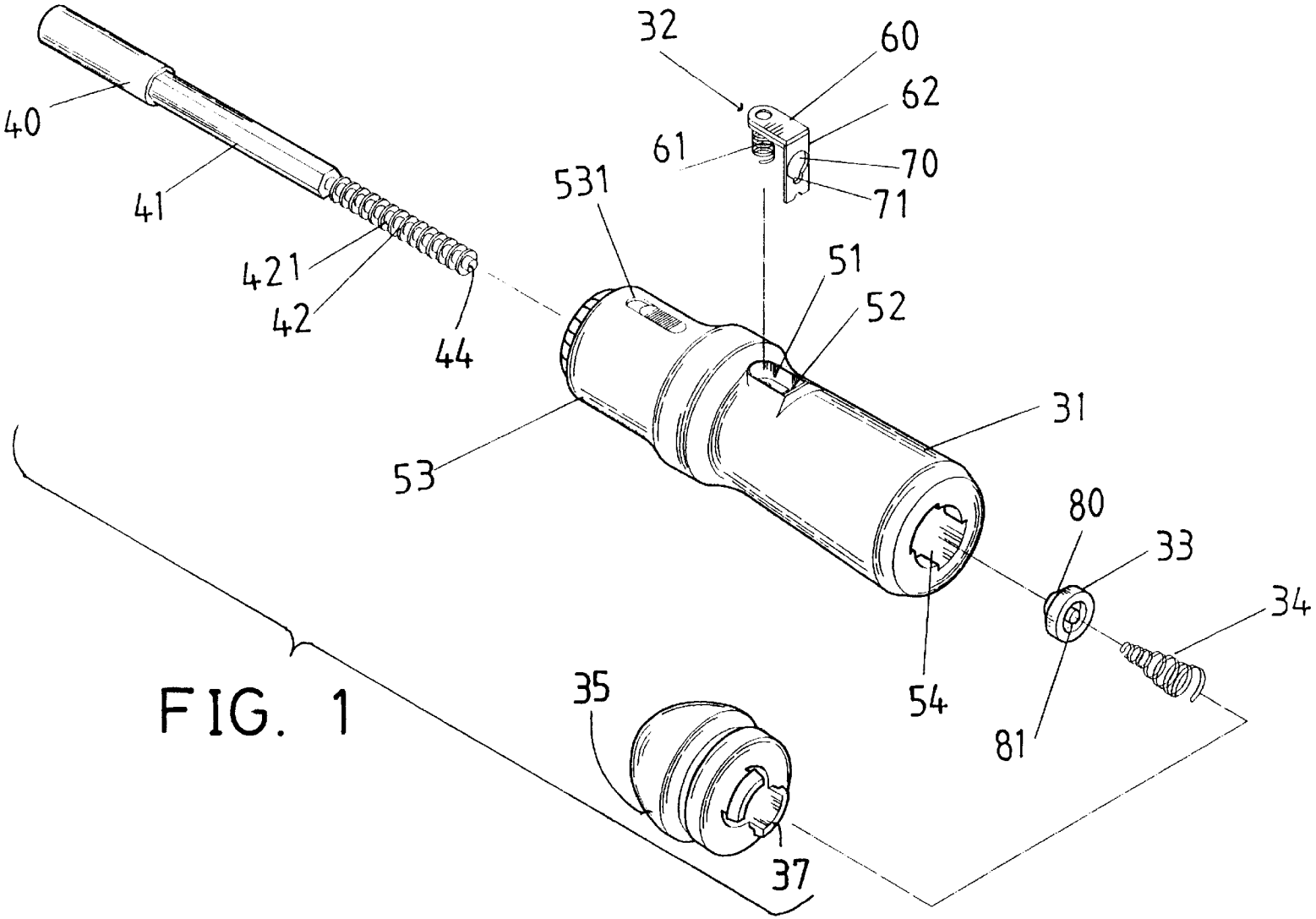
FIG. 1 is an exploded view of a retractable driving tool in accordance with the present invention.
Figure 2:
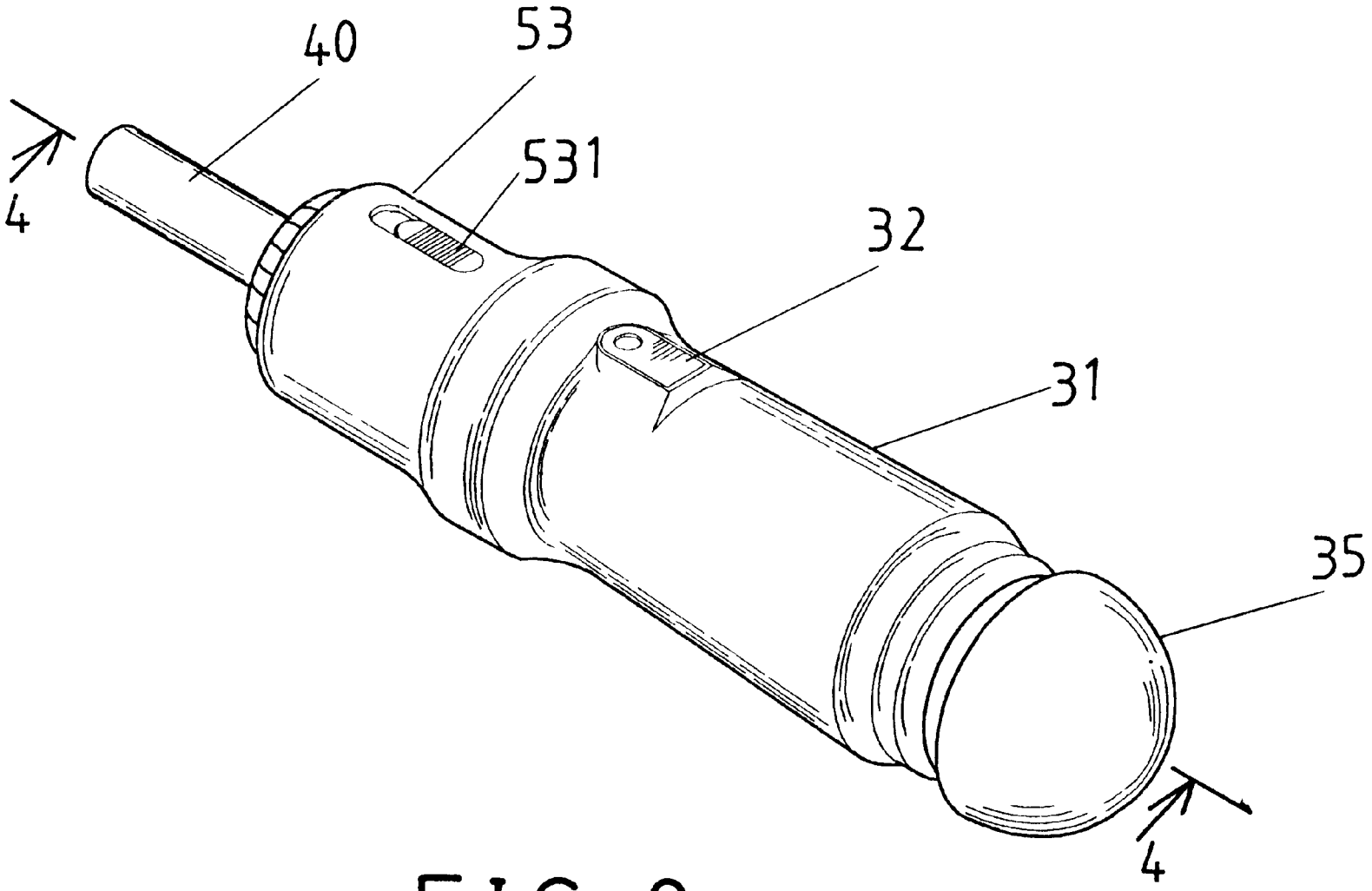
FIG. 2 is a perspective view of the driving tool, in which the driving stem is in a retracted position.
Figure 3:
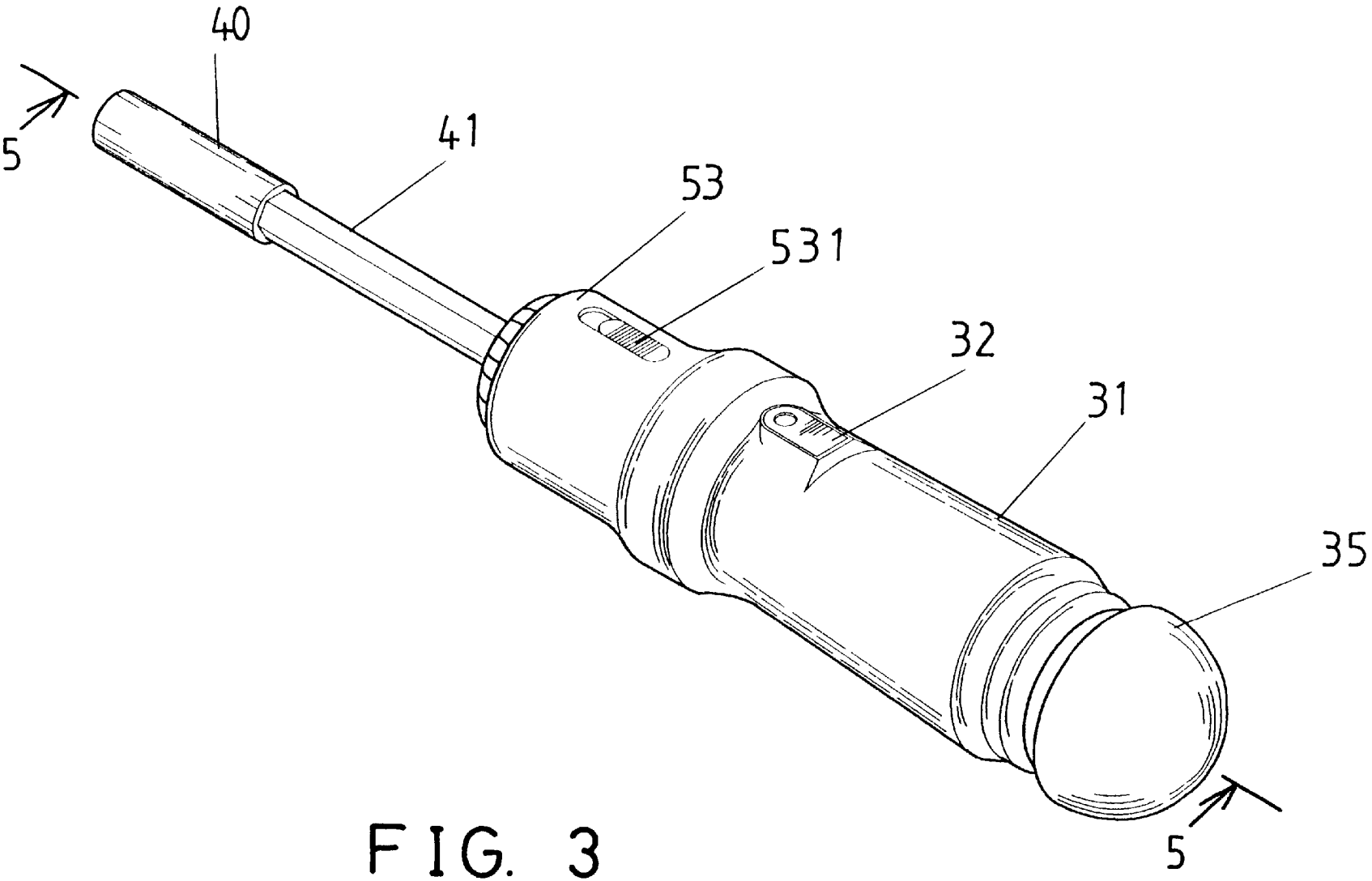
FIG. 3 is a perspective view of the driving tool, in which the driving stem is in an extended position.
Figure 4:
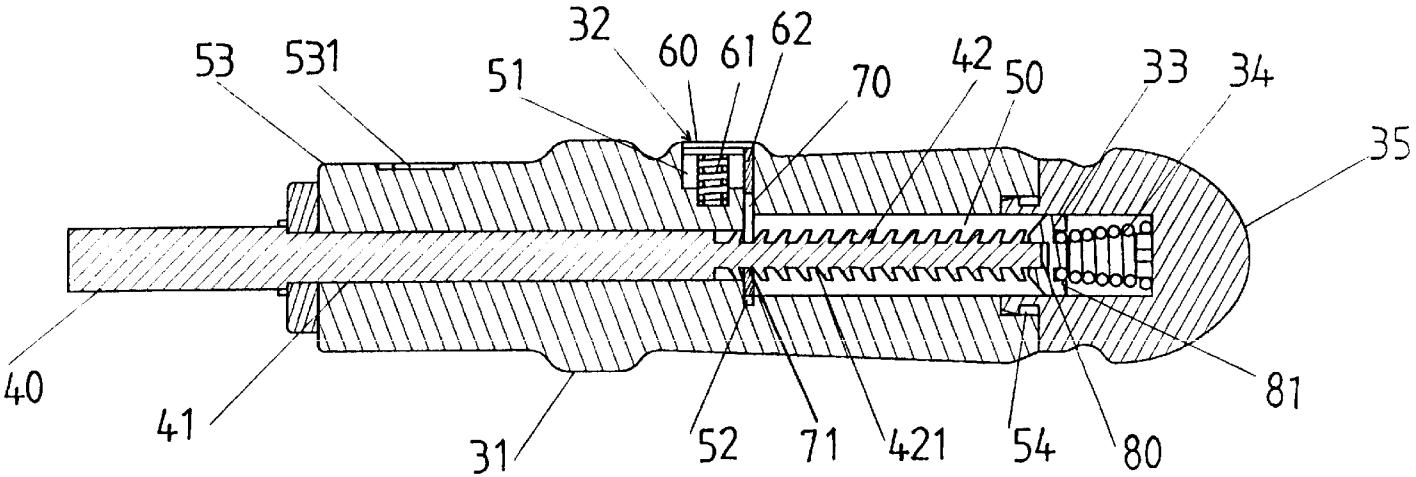
FIGS. 4 and 5 are cross sectional views taken along lines 4—4 and 5—5 of FIGS. 2 and 3 respectively.

As shown in FIGS. 1, 4 and 5, the driving stem 41 includes a number of teeth, particularly the ratchet teeth 42 formed in one end thereof for defining a number of grooves 421 therebetween. Or, alternatively speaking, the driving stem 41 includes a rod 44 extended therefrom and having the teeth 42 extended radially outward therefrom for defining the grooves 421 therebetween. The handle 31 includes a cavity 51 and a channel 52 formed therein and communicating, with each other. The channel 52 is also communicated with the bore 50 of the handle 31. A pawl 32 includes a knob 60 and a panel 62 slidably engaged in the cavity 51 and the channel 52 of the handle 31 respectively. The panel 62 includes a hole 70 formed therein and having a size no smaller than that of the teeth 42 of the driving stem 41 for slidably receiving the driving stem 41 and/or the teeth 42 of the driving stem 41. The panel 62 may further include a notch 71 formed therein and communicating with the hole 70 of the panel 62 for receiving the rod 44. The notch 71 includes a curvature or a shape corresponding to that of the rod 44 for stably receiving the rod 44. A spring 61 is received in the cavity 51 of the handle 31 and is engaged between the handle 31 and the knob 60 of the pawl 32 for biasing the panel 62 to engage with either of the teeth 42 and for securing the driving stem 41 to the handle 31 and for preventing the driving stem 41 from moving relative to the handle 31 (FIG. 4). The panel 62 may also be biased to engage with the teeth 42 without the notch 71 of the panel 62.

When it is required to extend or to retract the driving stem 41 relative to the handle 31, as shown in FIG. 5, the knob 60 of the pawl 32 is depressed downward against the spring 61 to disengage the panel 62 from the teeth 42 of the driving stem 41. The driving stem 41 may thus be moved relative to the handle 31 and may be secured to the handle 31 again when the knob 60 is released and when the panel 62 is biased to engage with the teeth 42 of the driving stem 41 again.

Referring again to FIGS. 1–5, the bore 50 of the handle 31 may include a rear portion having a size greater than that of the front portion of the bore 50 of the handle 31. A slide 33 is slidably received in the rear portion of the bore 50 of the handle 31 and includes a hub 80 provided in the front portion thereof for supporting and for securing the rear end of the driving stem 41 or the rear end of the rod 44 (FIGS. 4, 5). A cap 35 includes a latch 37 engaged in a rear opening 54 of the handle 31 for detachably securing the cap 35 to the rear portion of the handle 31. A spring 34 is engaged between the cap 35 and the slide 33 and preferably engaged in an annular slot 81 of the slide 33 for biasing the slide 33 and thus the driving stem 41 forward and outward of the handle 31. For example, as shown in FIG. 5, when the panel 62 is disengaged from the teeth 42 of the driving stem 41, the spring 34 may bias the driving stem 41 forward and outward of the handle 31 and the driving stem 41 may be moved inward of the handle 31 against the spring 34 until the panel 62 is biased to engage with the teeth 42 of the driving stem 41 again.

It is to be noted that the driving stein 41 may be moved relative to the handle 31 and may be secured to the handle 31 with the engagement of the pawl 32 with the teeth 42 of the driving stem 41. The driving stem 41 includes no telescopic structure such that the strength of the driving stem 41 will not be decreased.

Accordingly, the retractable driving tool in accordance with the present invention includes a simplified structure and includes a strength that will not be decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retractable driving tool comprising:

a handle including a bore formed therein, said handle including a cavity and a channel formed therein, said channel being communicating with said bore of said handle, a driving stem slidably received in said bore of said handle and including a rod extended therefrom, said driving stem including a plurality of teeth formed on said rod, a pawl slidably engaged in said handle for engaging with said teeth of said driving stem and for securing said driving stem to said handle, said pawl including a knob and a panel slidably received in said cavity and said channel of said handle respectively, said panel of said pawl including a hole formed therein for receiving said teeth of said driving stem, said panel of said pawl including a notch formed therein and communicating with said hole of said pawl for receiving said rod of said driving stem when said panel is biased to engage with said teeth of said driving stem, and means for biasing said pawl to engage with said teeth of said driving stem and to secure said driving stem to said handle, said biasing means being engaged between said handle and said pawl for biasing said panel of said pawl to engage with said teeth of said driving stem, said driving stem being allowed to be moved relative to said handle when said pawl is moved against said biasing means and disengaged from said teeth of said driving stem.

2. The driving tool according to claim 1, wherein said teeth of said driving stem are ratchet teeth, said driving stem includes a plurality of grooves formed between said teeth of said driving stem.

3. The driving tool according to claim 1 further comprising means for biasing said driving stem outward of said handle.

4. A retractable driving tool comprising:

a handle including a bore formed therein, said handle including a rear portion having a cap secured thereto, a driving stem slidably received in said bore of said handle and including a plurality of teeth formed thereon, said driving stem including a rear end located close to said cap, a pawl slidably engaged in said handle for engaging with said teeth of said driving stem and for securing said driving stem to said handle, means for biasing said pawl to engage with said teeth of said driving stem and to secure said driving stem to said handle, said driving stem being allowed to be moved relative to said handle when said pawl is moved against said biasing means and disengaged from said teeth of said driving stem, and a spring engaged between said cap and said rear end of said driving stem to bias said driving stem outward of said handle.

5. The driving tool according to claim 4 further comprising a slide slidably received in said bore of said handle and engaged between said spring and said rear end of said driving stem.

* * * * *